US005191923A

United States Patent [19]

Goss

[11] Patent Number: 5,191,923

[45] Date of Patent: Mar. 9, 1993

[54] IMPROVED USE OF SELF-LEVELING SHIMS IN CENTRIFUGAL APPARATUS

[75] Inventor: Douglas J. Goss, North Kingstown, R.I.

[73] Assignee: Conley Casting Supply Corp., Warwick, R.I.

[21] Appl. No.: 664,594

[22] Filed: Mar. 1, 1991

[51] Int. Cl.[5] ..... B22D 10/10

[52] U.S. Cl. ..... 164/292; 164/290; 425/425; 425/434; 264/311; 264/313

[58] Field of Search ..... 425/425, 8, 435, 589, 425/590, 451.9; 264/311, 313, 510; 164/201, 290, 292, 114

[56] References Cited

U.S. PATENT DOCUMENTS

| | | | |
|---|---|---|---|
| 3,280,434 | 10/1966 | Cecere | 164/258 |
| 3,961,014 | 6/1976 | Pasch et al. | 264/313 |
| 4,017,572 | 4/1977 | Magone et al. | 264/313 |
| 4,723,904 | 2/1988 | Maynard et al. | 425/425 |

*Primary Examiner*—Jan H. Silbaugh
*Assistant Examiner*—Angela Ortiz
*Attorney, Agent, or Firm*—Salter, Michaelson & Benson

[57] ABSTRACT

A self-leveling shim for centrifugal casting apparatus of the type wherein piston means maintain two-part elastomer molds in pressurized engagement with each other during the molding operation, said shim comprising an inflatable bladder positioned between said piston means and said molds, said bladder being inflatable only at selected portions thereof, so as to apply shim pressure at the portions of the molds where such pressure is required.

3 Claims, 2 Drawing Sheets

IMPROVED USE OF SELF-LEVELING SHIMS IN CENTRIFUGAL APPARATUS

BACKGROUND OF INVENTION

In the manufacture of intricate products, such as jewelry, it is common practice to make use of a rubber or silicon mold into which molten metal is poured, which mold is rotated to cause the metal to flow by centrifugal force into all parts of the mold cavity. A particularly desirable system for accomplishing this operation makes use of a generally disk-like mold which consists of upper and a lower halves, with mold cavities in each half facing one another across a parting plane consisting of facing surfaces. The mold cavities are positioned radially outward from the axis of the mold and feed passages lead from a central pouring passage outwardly to the cavities. During the molding operation, molten metal is poured into the central pouring passage and is forced by centrifugal force through the radial passages to the mold cavities.

As successive molding operations are carried out in a particular mold, the mating facing surfaces begin to wear, especially at the outer periphery of the cavities. When this happens, some of the molten metal may be forced from the mold cavities into the gap between the two mold halves caused by the wear. This results in an undesirable "flash" on the cast product. Since this defect in the product is unacceptable, it is necessary either to discard the flawed product or to perform an expensive hand operation to remove the flash, and the worn mold must be discarded.

Various methods have been used in the past in order to compensate for the wear at the mold separating surfaces and to prevent flashing. Since the mold is enclosed in a housing and clamped by a piston during the pouring and rotating operations, it is sometimes possible to insert a shim between the piston and the mold, so that the mold is compressed to close the gap that would otherwise exist due to the wear. One such shim consists of several layers of paper in the shape of rings. Since these paper rings are all of the same thickness, there is no greater pressure on the worn parts of the mold than there is on the rest of the mold, so that the shim has only limited effect in preventing flashing on the finished product. On occasion, attempts have been made to overcome the effect of wear by using a shim made of a foamed material, such as rubber or an elastomer. Here again, the pressure produced on the mold is the same all around its periphery, thus minimizing the effectiveness of the shim.

So far as the prior art is concerned, the CECERE, U.S. Pat. No. 3,280,434 discloses a mat which is positioned beneath the mold, but the mat is not inflatable, a primary feature of the present invention, and is not indicated as performing a shim function. The same is true of the material disclosed in the COREA, U.S. Pat. No. 4,350,481, which shows a lower plate underneath a mold half, but here again the plate is neither inflatable nor does it act as a shim. The ARONS, U.S. Pat. No. 4,294,792 does appear to address the problem of flash, but the concept of an inflatable shim is completely absent.

With regard to the concept of a hollow bladder to be used as a shim in a mold system, the BULL, U.S. Pat. No. 2,739,093 shows a method of producing a tufted article by thermal bonding in a criss-cross pattern. The PRISK, U.S. Pat. No. 3,829,342 shows a hollow bladder used as a pump. The ELKINS, U.S. Pat. No. 3,830,676 shows a device for cooling and heating of the human body or the like, in which two sheets of a waterproof material are sealed together in an intricate pattern to receive suitable cooling or heating fluid. The KIEVES, U.S. Pat. No. 4,917,646 illustrates a balloon formed from two sheets of flexible plastic bonded together and including an inflating valve. None of these structures would seem to show or suggest a solution to the problem of flash in a centrifugal molding system. These and other difficulties experienced with the prior art systems have been obviated in a novel manner by the present invention.

It is, therefore, a primary object of the invention to provide a centrifugal mold system in which flash in the finished molded product is substantially reduced.

Another object of this invention is the provision of a shim for use in a centrifugal mold system that will eliminate the formation of a gap and the production of flash as the mold becomes worn.

A further object of the present invention is the provision of a mold system having a compensating shim to eliminate any gap between the mold halves.

A still further object of the invention is the provision of a shim which automatically compensates for wear in a mold at the locations where the wear takes place.

It is a further object of the invention to provide a mold shim which is simple and rugged in construction, which can be inexpensively manufactured from readily available materials, and which is capable of a long life of useful service.

Another object of the invention is the provision of a shim for a centrifugal molding system, which shim will prolong the useful life of the mold.

With these and other objects in view, as will be apparent to those skilled in the art, the invention resides in the combination of parts set forth in the specification and covered by the claims appended hereto.

SUMMARY OF THE INVENTION

In general, the invention consists of a conventional mold system for the centrifugal casting of jewelry and the like, which system has a rotatable housing with a generally tubular interior and a clamping piston. A rubber mold positioned in the housing consists of two disk-like halves with facing surfaces adapted to be pressed together, each such surface being formed with one or more mold cavities. A shim is located between the mold and the piston, the shim having the same general peripheral shape as the mold and serving to compress the mold at selected locations to close any gap that may result from wear at said locations.

More specifically, the mold shim of the present invention is formed from two sheets of elastomer material joined at their peripheries to form a hollow interior which contains a fluid that is capable of migration from one part of the interior to another in response to differences in pressure on the exterior of the sheets. The sheets are joined or fused at selected locations to define a hollow interior having a predetermined pattern comprising two concentric annular passages having a series of radial passages bridging said annular passages.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
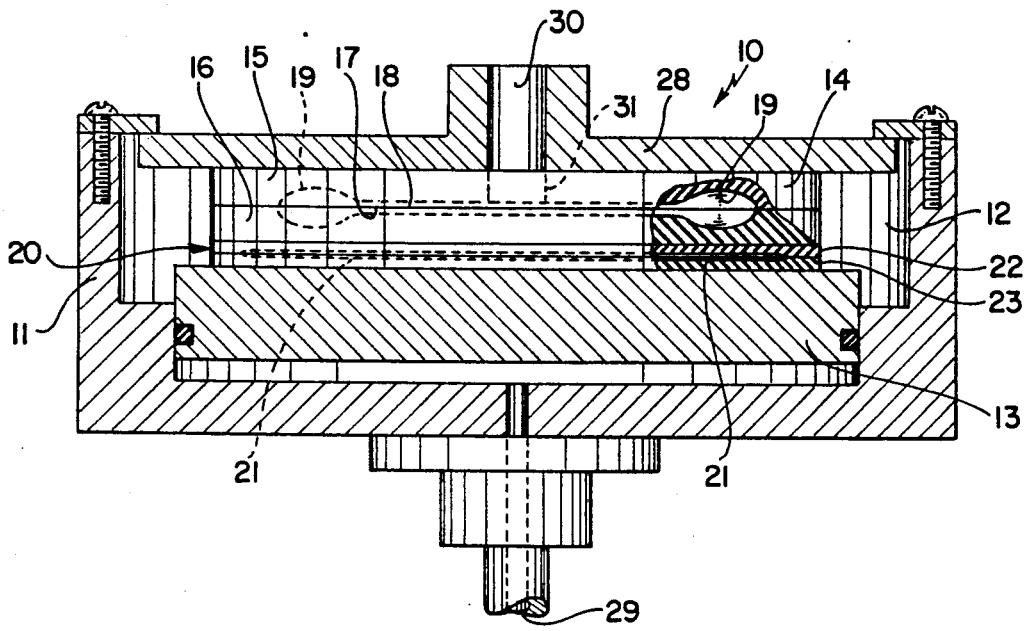
FIG. 1 is a vertical sectional view of a centrifugal mold system incorporating the shim of the present invention, with portions broken away for illustration.

Referring first to FIG. 1, which best shows the general features of the invention, the mold system, indicated generally by the reference numeral 10, is shown as specifically constructed for the centrifugal casting of intricate products, such as jewelry. It is provided with a rotatable head or housing 11 having a generally tubular interior 12 containing a clamping piston 13. A rubber mold 14 is positioned in the interior of the housing and consists of two disk-like halves 15 and 16 having facing radial surfaces 17 and 18, respectively. Each radial surface is formed with one or more mold cavities 19 and with associated passages or runners through which molten metal may flow to reach the cavities.

A mold shim 20 is located between the piston 13 and the mold and has substantially the same peripheral shape as the mold. This shim enhances the pressure exerted by the piston in clamping the mold halves together and specifically causes increased pressure to automatically be exerted at those locations where there is any wear at the peripheries of cavities 19, thus compensating for any gap that may exist between the facing radial surfaces 17 and 18 of the mold at those locations. The shim has a hollow interior 21 that contains a fluid, preferably a liquid that can migrate within the shim to the point of least resistance, i.e. the portion thereof that lies adjacent any portion of the mold having wear or a gap that can cause the formation of flash.

Figure 2:
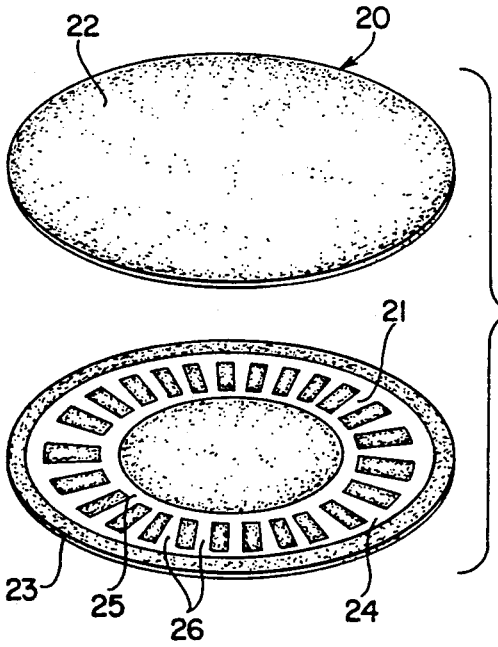
FIG. 2 is an exploded perspective view of the mold shim components.

As is evident in FIG. 2, the shim 20 is formed of two circular sheets 22 and 23 of elastomer material that are fused or joined together at their peripheries and form the said hollow interior 21 in those portions where the sheets are not so joined. The darkened pattern shown on the sheet 23 represent areas where the two sheets of uncured elastomer are joined during curing, leaving the other areas unconnected to form the hollow interior. The hollow interior includes at least one annular passage 24 that extends entirely around the shim adjacent the location where the sheets are joined along their peripheries. This allows for distribution or flow of liquid positioned within the hollow portion of the shim to any part of said hollow portion. The hollow interior includes another concentric annular passage 25 closer to the center of the shim, it being noted that these two concentric annular passages 24 and 25 are joined by a plurality of radially-extending bridge passages 26 to assist in the distribution or flow of liquid throughout the hollow pattern.

Figure 3:
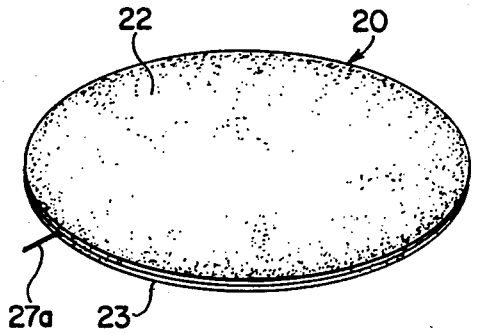
FIG. 3 is a perspective view of the mold shim of FIG. 2 after the components have been fused to each other.
Figure 4:
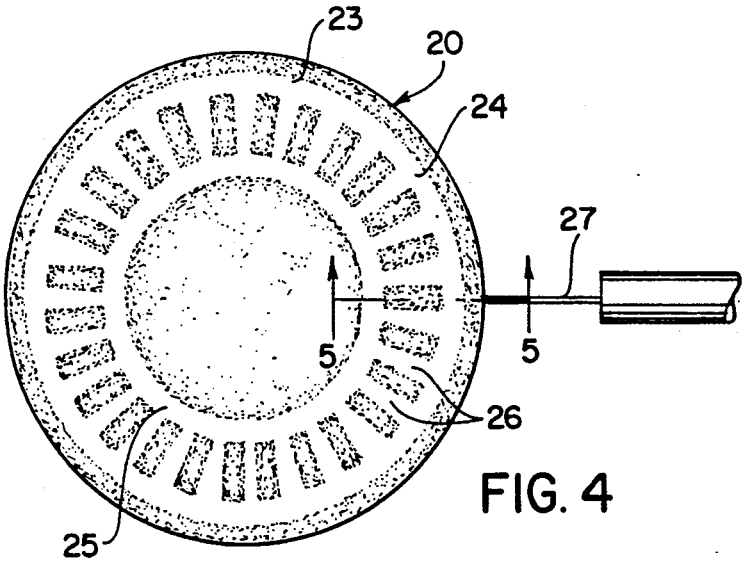
FIG. 4 is a plan view of the mold shim showing how fluid is introduced therein.
Figure 5:
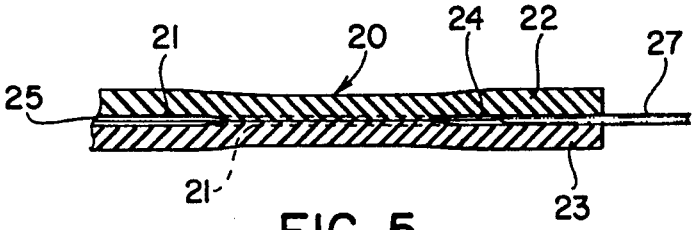
FIG. 5 is an enlarged fragmentary section taken on the line 5—5 of FIG. 4.

FIGS. 3, 4, and 5 illustrate the manner in which the hollow interior of the completed shim 20 is supplied with the liquid, which may be any inert substance, such as peanut oil. The liquid is contained in the barrel of a hypodermic needle 27 and the needle is inserted between the sheets at the periphery of the shim and is moved far enough inwardly so that the tip of the needle resides in the annular passage 24. After a preselected amount of liquid has been introduced, the needle is completely withdrawn and a cement-covered plug 27*a* is placed in the aperture left by the needle to seal the opening formed by the needle. The outwardly extending portion of plug 27*a* is then trimmed off so as to leave no outward extension. Normally, the curing of the elastomer, which leaves the passage pattern areas unconnected, leaves those areas in physical contact, but the introduction of the liquid expands the elastomer in those areas to form full passages with substantial cross-sectional areas. It will be understood, therefore, that differences in pressure of the fluid in various parts of the passage pattern will cause differing amounts of swelling of the shim at the various locations of the passages.

In the preferred embodiment of the invention, the pattern of unjoined areas shown in FIGS. 2 and 4 is produced by applying a pattern of any known release agent to the surface of the sheet 23 by the well-known "silk screening" process, although it can also be produced by using a stencil. When the sheets are subsequently cured or vulcanized, this release agent will prevent the sheets from vulcanizing together in those areas where it is applied. At the same time, it will be understood that the sheets will be fused or joined securely in those areas that did not receive the release agent.

In a practical embodiment of the invention, the mold 14 is made of rubber. The shim 20 is formed from two sheets of nitrile having a durometer of 65 and using powdered or pulverized teflon as the release substance or parting agent. The mold and shim were both 9" in diameter. The outer annular passage 24 of the shim was ¾" wide, while the inner annular passage 25 was ¼" wide. Twentyfour radial bridge passages 26 were provided spaced 15 degrees apart; each radial passage tapers from ⅝" wide at the outer end to ½" at the inner end. The amount of liquid can be varied from 4 cc to 12 cc. It has been found that one should use less oil when the rubber in the mold is harder. A shim that has a diameter of 12" would use an amount of liquid in the range from 8 to 24 cc. It is advantageous to use coloring matter in the liquid to give a warning of any leakage. Some of the critical factors in determining the operation of the shim are as follows:

(1) the amount of liquid,
(2) the thickness of elastomer,
(3) the number and width of the radial bridge passages, and
(4) the durometer of the elastomer.

The operation and the advantages of the present invention will be readily understood in view of the above description. With a cover 28 removed from the housing 11, the shim 20 is placed on the exposed upper surface of the clamping piston 13. The mold 14 is then inserted and rests on the shim. The replacement of the cover 28 results in the mold being held between the cover (on the one hand) and the shim and piston (on the other hand). The piston 13 is then driven upwardly by air pressure introduced through a passage 29, so that the piston moves upwardly, pressing the shim against the mold and pressing the mold upwardly against the cover. The facing radial surfaces 17 and 18 of the mold are, thus, held tightly together. Molten metal is poured into a central opening 30 in the cover, so that it flows into the mold through a gate system including a passage 31 formed in the upper half 15 of the mold and into the runners that extend to the mold cavities 19. The housing 11 is then rotated about its centerline and that of the mold at approximately 300 rpm to distribute the molten metal to all parts of the mold cavities by centrifugal force. After a suitable cooling period, the apparatus is dismantled and the molded metal parts removed, trimmed and otherwise finished as is conventional.

As long as the facing radial surfaces 17 and 18 are flat and undamaged, the mold cavity 19 will form the product accurately and without flash. If, however, the mold becomes worn, as is wont to happen at the peripheries of cavities 19, a gap may appear between the mating surfaces and this gap will receive metal and form an undesirable appendage or "flash" on the finished product. The product must then be discarded or subjected to a secondary operation (usually, manual), either of which alternative is costly.

According to the present invention, however, if a wear gap exists between the radial surfaces of the mold, the mold halves, being somewhat flexible (since they are made of a rubber-like substance), will exert less pressure against each other in the vicinity of the gap. The shim 20 will feel a stronger pressure in the part of the mold that has no gap and the liquid will automatically migrate to the points of least resistance so as to exert increased pressure between the mold halves where they are worn, thus counteracting the tendency of undesirable gaps forming at such worn locations. The flow or migration of the liquid can take place in a complex form, since the liquid is free to move radially inwardly and outwardly between the outer annular passage 24 and the inner annular passage 25 via the bridge passages 26. In addition, the liquid is free to flow around the annular passages from one segment of the shim to another. It might be said, then, that the shim is selfleveling in the sense that the thickness and the pressure applied to the mold is distributed automatically to the points where additional pressure is needed.

It can be appreciated, then, that the use of the shim of the invention allows the use of a worn mold that otherwise would be considered useless. The useful life of a given mold is greatly extended and the operation of the manufacturing plant is rendered much more efficient.

Figure 6:
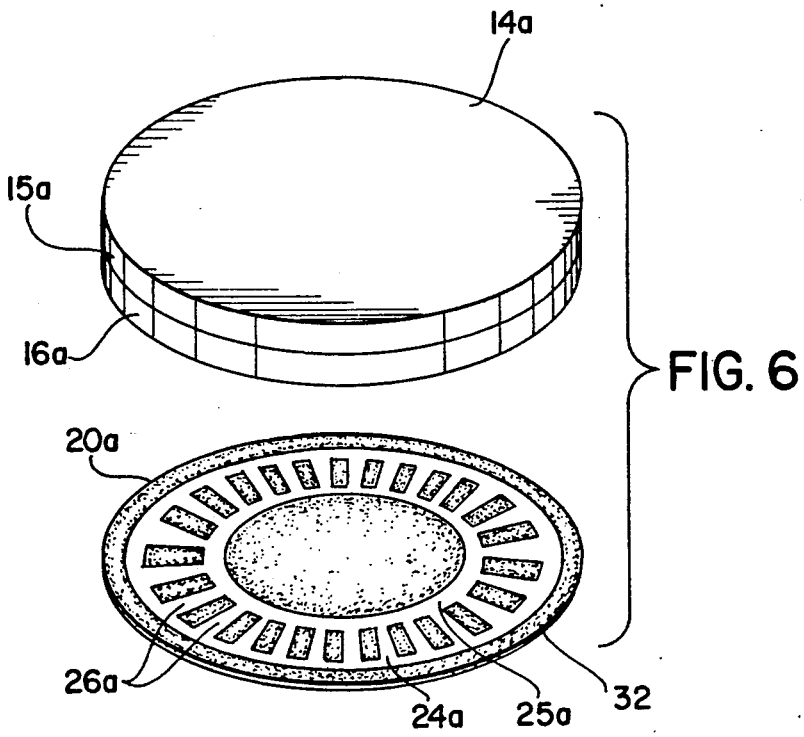
FIG. 6 is an exploded perspective view of an alternative form of the present invention.

FIG. 6 shows a modified form of the invention in which the shim becomes an integral part of the mold. The mold 14*a* is illustrated as having two halves 15*a* and 16*a*. The shim 20*a* takes the form used in the lower sheet 23 of the version shown in FIG. 2. That is to say, it is provided with a pattern of release substance that defines an outer peripheral junction strip 32, an outer annular passage 24*a*, an inner annular passage 25*a*, and radial bridge passages 26*a*. The bottom half 16*a* of the mold and the sheet of the shim 20*a* are formed of compatible uncured elastomer materials, so that they can be cured together to form an integral shim on the undersurface of the mold. The liquid is injected into the hollow interior thus formed in the same manner as previously described, and the operation described above in connection with the first version of the invention will take place in the same way.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

What is claimed is:

1. In centrifugal casting apparatus of the type comprising a housing, a clamping piston mounted in said housing for receiving thereon an elastomer mold comprising face-to-face mold halves having cooperating mold cavities on their abutting inner surfaces, and a fixed cover engaging the top of said mold whereby movement of said piston toward said cover causes clamping of said mold halves against each other, the improvement comprising a shim located between said piston and said mold to compress the latter at selected locations to close any gap between said abutting surfaces, said shim comprising a hollow inflatable circular bladder having opposed walls secured to each other at selected locations to define a predetermined pattern of unsecured inflatable portions, and fluid means within said bladder that automatically migrates within the confines of said pattern to the location where any such gap exists, said shim being an integral part of one of said mold halves.

2. The apparatus of claim 1 further characterized in that the outer surface of said one mold half comprises one of said opposed bladder walls, the other wall being sealed thereto at its peripheral edge to define said hollow bladder.

3. In centrifugal casting apparatus of the type comprising a housing, a clamping piston mounted in said housing for receiving thereon an elastomer mold comprising face-to-face mold halves having cooperating mold cavities on their abutting inner surfaces, and a fixed cover engaging the top of said mold whereby movement of said piston toward said cover causes clamping of said mold halves against each other, the improvement comprising a shim located between said piston and said mold to compress the latter at selected locations to close any gap between said abutting surfaces, said shim comprising a hollow inflatable circular bladder having opposed walls secured to each other at selected locations to define a predetermined pattern of unsecured inflatable portions, and fluid means within said bladder that automatically migrates within the confines of said pattern to the location where any such gap exists, said pattern comprising a first outer annular passage located adjacent the outer periphery of said bladder, a second angular passage spaced radially inward from said first passage, and a plurality of radially extending passages bridging said first and second annular passages.

* * * * *